US006219885B1

(12) United States Patent
Faas et al.

(10) Patent No.: US 6,219,885 B1
(45) Date of Patent: Apr. 24, 2001

(54) HIGH PERFORMANCE CARD

(75) Inventors: Jürg Faas, Andelfingen; Beat Näf, Jona; Olivier Wüst, Seuzach; Christian Sauter, Flurlingen; Theodor Gresser Götz, Winterthur, all of (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/440,320

(22) Filed: Nov. 12, 1999

Related U.S. Application Data

(63) Continuation of application No. 09/028,425, filed on Feb. 24, 1998, now abandoned.

(30) Foreign Application Priority Data

| | | |
|---|---|---|
| Feb. 24, 1997 | (CH) | 0438/97 |
| Jun. 3, 1997 | (CH) | 1318/97 |
| Jul. 31, 1997 | (CH) | 1838/97 |
| Sep. 12, 1997 | (CH) | 2154/97 |

(51) Int. Cl.[7] ..... D01G 15/00
(52) U.S. Cl. ..... 19/98; 19/113; 19/114
(58) Field of Search ..... 19/98, 99, 102, 19/104, 105, 106 R, 112, 113, 114, 65 A, 200, 203, 204; 492/29, 50, 51, 52, 55

(56) References Cited

U.S. PATENT DOCUMENTS

| | | | |
|---|---|---|---|
| 2,478,799 | | 8/1949 | Wilkinson . |
| 2,785,443 | * | 3/1957 | Van Den Abeele ..... 19/113 |
| 3,044,475 | | 7/1962 | Thompson . |
| 3,151,362 | | 10/1964 | Mathibu et al. . |
| 3,308,511 | | 3/1967 | Culpan . |
| 3,604,062 | | 9/1971 | Hollingsworth . |

(List continued on next page.)

FOREIGN PATENT DOCUMENTS

| | | |
|---|---|---|
| 177219 | 3/1935 | (CH) . |
| 588694 | 3/1959 | (CH) . |
| 191182 | 4/1907 | (DE) . |
| 1486385 | 6/1939 | (DE) . |
| 1694956 | 12/1954 | (DE) . |
| 1733250 | 6/1956 | (DE) . |
| 1037332 | 8/1958 | (DE) . |
| 1106653 | 11/1961 | (DE) . |
| 1296553 | 5/1969 | (DE) . |
| 1938539 | 2/1970 | (DE) . |
| 2816900 | 10/1978 | (DE) . |
| 2742420 | 3/1979 | (DE) . |
| 2911361 | 10/1980 | (DE) . |

(List continued on next page.)

OTHER PUBLICATIONS

"High–Speed Carding and Continuous Card Feeding", The Institute Series on Textile Processing, vol. II, Institute of Textile Technology.

Entwicklungen Auf Dem Cebiet Der Kardengaruiturkonstruktion, Textil Praxis International, Sep., 1994.

The Textile Institute Handbuch Der Textilen Fertigung, Die Kurzstapelspinnerei, Band 2: Putzeri Und Karderie.

European Patent Office Search Report, Jun. 3, 1998.

Patent Abstract of Japan, Publication NO. 61022927, Jan. 31, 1986.

EPO Search Report, Dec. 18, 1998.

*Primary Examiner*—Michael A. Neas
*Assistant Examiner*—Gary L. Welch
(74) *Attorney, Agent, or Firm*—Dority & Manning

(57) ABSTRACT

The main drum diameter (D) of a card for short staple carding is reduced. The working width preferentially is enlarged. The main drum (50) can be made from fiber reinforced synthetic material. Notwithstanding its smaller diameter, the new main drum is operated at the same or a somewhat higher circumferential speed (in comparison to a conventional card).

21 Claims, 11 Drawing Sheets

U.S. PATENT DOCUMENTS

| | | | | |
|---|---|---|---|---|
| 3,685,100 | | 8/1972 | Brown et al. . | |
| 3,730,802 | | 5/1973 | Stewart et al. . | |
| 3,737,951 | | 6/1973 | Mackie . | |
| 3,808,640 | | 5/1974 | Graf . | |
| 3,858,276 | | 1/1975 | Hollingsworth . | |
| 4,126,914 | | 11/1978 | Winch et al. . | |
| 4,162,559 | | 7/1979 | Stewart . | |
| 4,219,908 | | 9/1980 | Winch et al. . | |
| 4,270,246 | | 6/1981 | Beneke . | |
| 4,295,248 | | 10/1981 | Beneke et al. . | |
| 4,352,223 | | 10/1982 | Felix et al. . | |
| 4,356,597 | | 11/1982 | Graf . | |
| 4,357,738 | | 11/1982 | Siegrist . | |
| 4,408,371 | | 10/1983 | Quay . | |
| 4,553,288 | | 11/1985 | Schneider et al. . | |
| 4,698,879 | | 10/1987 | Landwehrkamp . | |
| 5,095,585 | | 3/1992 | Grimshaw et al. . | |
| 5,101,542 | * | 4/1992 | Nakagawa et al. | 28/282 |
| 5,142,741 | | 9/1992 | Demuth et al. . | |
| 5,142,742 | | 9/1992 | Erni et al. . | |
| 5,218,740 | | 6/1993 | Snyder et al. . | |
| 5,230,135 | | 7/1993 | Kuehl . | |
| 5,271,125 | | 12/1993 | Leifeld et al. . | |
| 5,295,284 | | 3/1994 | Demuth et al. . | |
| 5,355,560 | | 10/1994 | Fritzsche et al. . | |
| 5,467,505 | | 11/1995 | Graf . | |
| 5,473,795 | | 12/1995 | Spix et al. . | |
| 5,542,154 | | 8/1996 | Demuth et al. . | |
| 5,855,043 | | 1/1999 | Leifeld . | |
| 6,016,650 | * | 1/2000 | Legrom | 57/413 |

FOREIGN PATENT DOCUMENTS

| | | | | |
|---|---|---|---|---|
| 3336825A1 | | 7/1984 | (DE) . | |
| 3318580A1 | | 11/1984 | (DE) . | |
| 8803283 | | 6/1988 | (DE) . | |
| 4331284A1 | | 3/1994 | (DE) . | |
| 0810309A1 | | 12/1997 | (DE) . | |
| 19631809 | | 2/1998 | (DE) . | |
| 0446796A1 | | 9/1991 | (EP) . | |
| 0497745A1 | | 8/1992 | (EP) . | |
| 0626220A1 | | 11/1994 | (EP) . | |
| 0753610A1 | | 1/1997 | (EP) . | |
| 0790338A3 | | 8/1997 | (EP) . | |
| 1687 | * | 2/1888 | (GB) | 19/113 |
| 11385 | * | 5/1898 | (GB) | 19/113 |
| 739311 | | 10/1955 | (GB) . | |
| 1319598 | | 6/1973 | (GB) . | |
| 1500106 | | 2/1978 | (GB) . | |
| 2020330 | | 11/1979 | (GB) . | |
| 1584938 | | 2/1981 | (GB) . | |
| 2258471A | | 2/1993 | (GB) . | |
| 2266539 | | 11/1993 | (GB) . | |
| 2323099 | | 9/1998 | (GB) . | |

* cited by examiner

Fig. 2
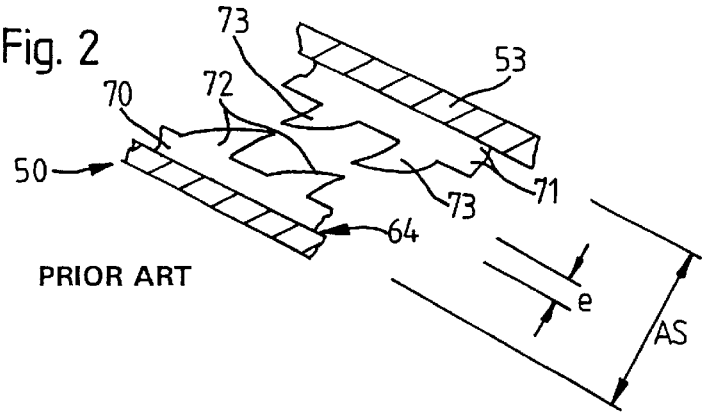
PRIOR ART
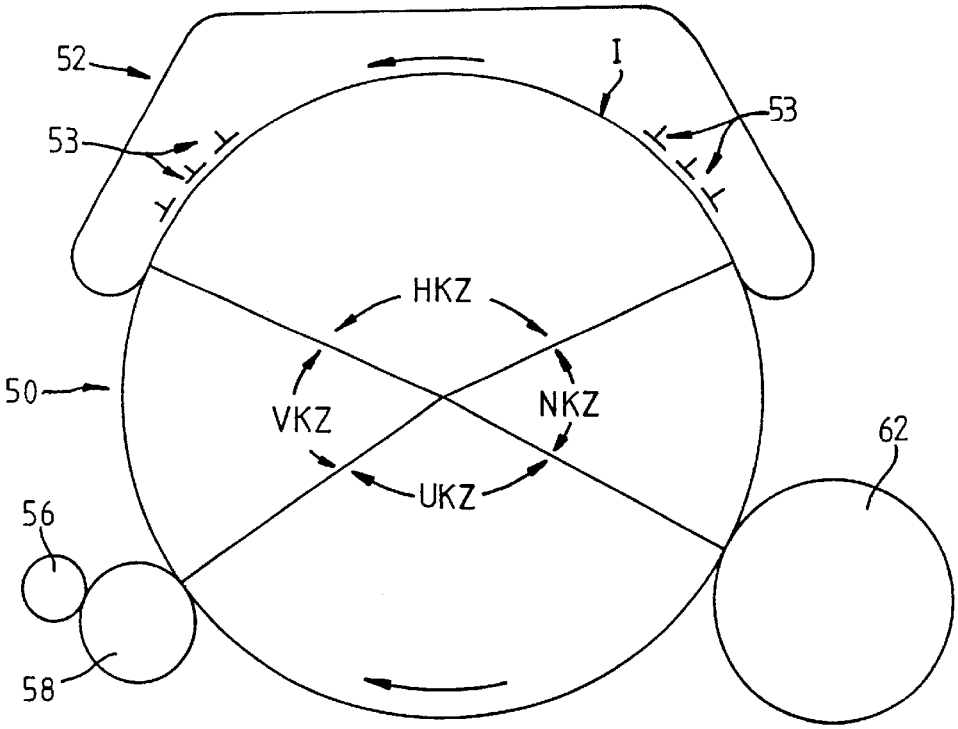
Fig. 1 PRIOR ART

Fig.21
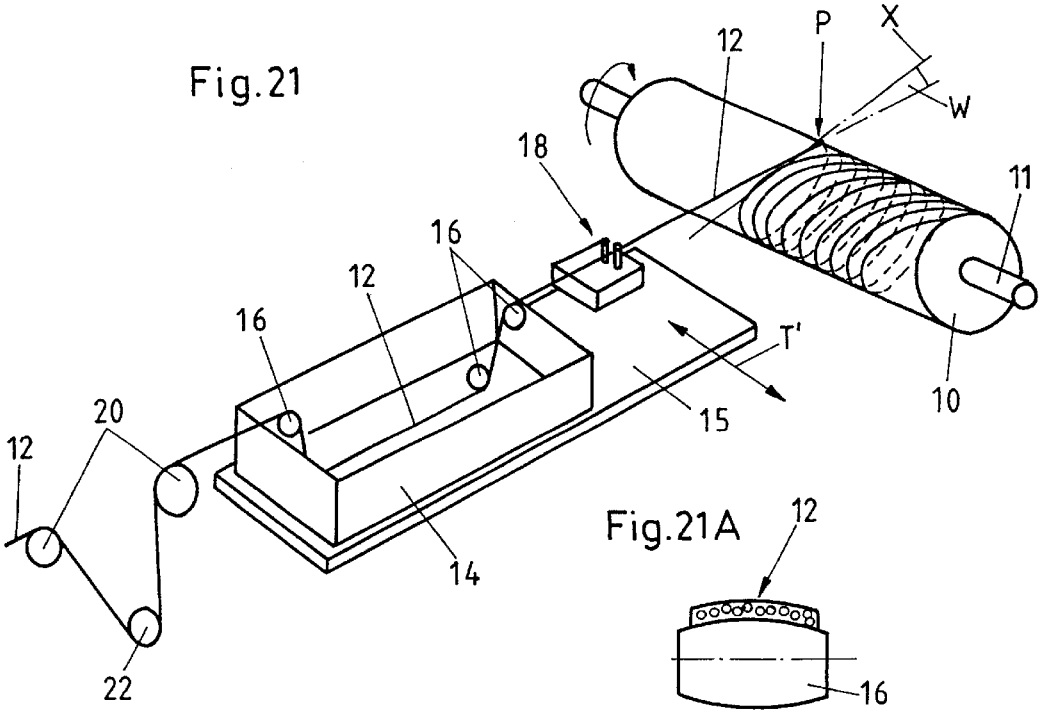
Fig.21A
Fig. 23
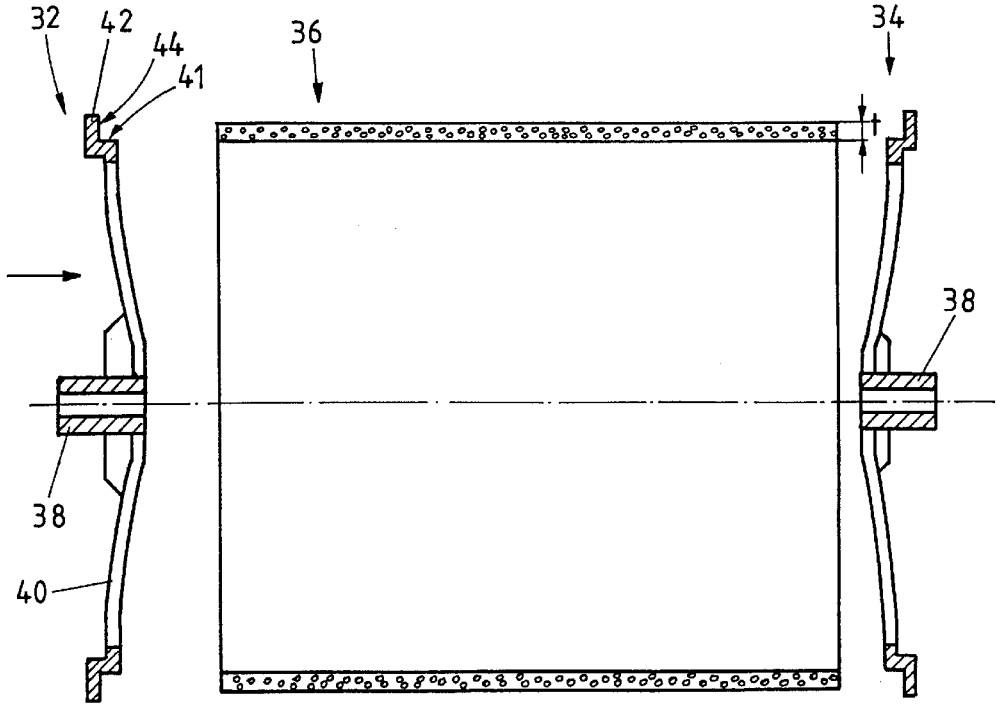

HIGH PERFORMANCE CARD

This application is a Continuation Application of U.S. application Ser. No. 09/028,425, filed Feb. 24, 1998 abnd.

BACKGROUND OF THE INVENTION

The present invention concerns the carding process of textile fibres (in particular "short staple fibres" of a maximum fibre length of up to 60 mm).

STATE OF THE ART

A modern card comprises a so-called main drum (also called main cylinder) or two drums of large dimensions. This (or each) drum co-operates with a flat arrangement for performing the actual carding action. In order to maintain the material flow the drum (or the pair of drums, respectively) co-operates with a feed system (feed roll and licker-in, also called taker-in) and with a fibre take-off system. The feed system processes fibres normally supplied in batt form. The take-off system normally is laid out for forming a sliver. Each "working element" (drum, licker-in, take-off roll, flats) is provided with a so-called clothing which performs the actual processing of the fibres. Between the drum and its "cover" (be it in the form of a working element or in the form of an element with a covering function) a "working gap" is provided. The feed system is to be laid out for feeding fibres to be processed to the drum as evenly as possible over the full working width of the working elements, i.e. over the full width provided with clothing for processing fibres. The take-off system is laid out for collecting processed fibres as evenly as possible over this full width.

The main drum is the "heart" of the carding machine and fundamentally influences all of its functions. In particular the fibre stream is opened completely to the individual fibre and is cleaned thoroughly only after it has reached the main drum. Cleaning is effected by eliminating undesirable matter from the path of transport which is defined by the working gap at the circumference of the drum. "Undesirable" matter comprises e.g. dust, trash particles, neps that cannot be disentangled, and short fibres (unspinnable fly waste). The "selectivity" of the elimination process, however, is of decisive importance—the "desirable" material (good fibres) is to be first carried forward as completely as possible in the working gap and subsequently transferred to the subsequent working element for the formation of a sliver.

Today a conventional card is provided with a drum of a diameter of about 1000 to about 1300 mm, the working width being about 1000 mm.

"Small" cards have been proposed and applied in practical use. They were deemed unsatisfactory, however (see "High-Speed Carding and Continuous Card Feeding", Dr. Zoltan S. Szaloki, page 87; Editor: Institute of Textile Technology, Charlottesville, Va., U.S.A.). Cards of this type (to the knowledge of the applicant) no longer are in practical use. EP-A-446 796

A card of a new type has been described in EP-A-446 796. According to this earlier proposal a card for achieving higher precision is characterized in that the working width is limited in such a manner that it does not exceed 800 mm, and is in the range of e.g. 400 to 600 mm, and preferentially is reduced to below 400 mm. This proposal did not yield satisfactory results in practical application and no machines of this type were tested outside the laboratories. In a further step according to EP-A-446 796 it was proposed that the diameter of the drum, or of its working surface, respectively, be limited in such a manner that it does not exceed 800 mm and preferentially ranges between 350 and 450 mm. Notwithstanding the reduction in diameter this drum was meant to also co-operate directly with the feed system and the take-off system, i.e. the card comprised only one single drum. The card preferentially was laid out as a revolving flat card.

All elements influencing the working gap (e.g. the main drum and the flats) according to EP-A-446 796 preferentially were meant to be made from a material of high elastic modulus in order to reduce bending over the working width. According to EP-A-446 796 steel and fibre reinforced synthetic materials were indicated. The material chosen was to ensure the desired dimensional stability of the element (a corresponding manufacturing method being applied) and to maintain it during operation. Accordingly the material was supposed to show a low heat expansion coefficient and/or a higher heat conductivity in order to prevent the heat losses (which inevitably occur at high production rates) from causing disturbing deformations of the working elements.

EP-A-446 796 was based on the principle that the carding process was to remain basically unchanged. Thus corresponding reductions in the diameter of the licker-in, and of the take-off roll respectively, were proposed according to the reduction of the main drum diameter, e.g. maintaining the usual relations of these diameters.

SUMMARY OF THE INVENTION

The present invention provides a card equipped with at least one main drum, a cylindrical surface of the main drum being provided with a clothing, or prepared to take up a clothing respectively, which defines the working width of the card. The card comprises a feed means for feeding fibres to be carded to the main drum evenly over the full working width as well as a take-off means for taking off carded fibres evenly over the full working width. Also a flat arrangement is provided for carding fibres on the drum over the full working width. The card is characterized in that the diameter of the main drum ranges from 700 to 1000 mm, e.g. between 700 and 900 mm. This diameter advantageously can be chosen between 750 and 850 mm.

The working width preferentially exceeds 1300 mm, and is e.g. 1500 mm.

A card according to the present invention can be laid out as a revolving flat card or as a fixed flat card.

The small drum card preferentially is driven at a relatively high rotational speed in such a manner that a higher circumferential speed is effected than applied on conventional cards up to now. It thus becomes possible to improve the selectivity of the elimination process. The total (stress) load to which the fibres are subject in the card, however, should not be increased, which limits the number of working elements.

Card designers are permanently challenged to improve the precision of the elements forming the working gap. Achievement of higher precision, however, causes higher cost already in the manufacture of the individual elements, e.g. in the machining of a cast element as the narrow tolerances required cannot be met if a casting process is used. The problem is complicated further as the rotating elements are subject to deformations during operation under the influence of the centrifugal forces and to heat-induced expansion. The problem of deformations increases in a non-linear proportion with increasing rotational speeds. At higher rotational speeds care also is to be taken that no vibrations of the working elements, or of their support structures respectively, are caused, which could adversely influence the gap width decisively. Eccentricities of rotating elements in this connection also can exert a considerable influence.

The main drum of a conventional card is made from steel or from cast iron. Certainly it is possible to fulfil ever more stringent requirements using these materials. Fulfilment of the new requirements using conventional materials, however, results in disproportionate increases in manufacturing cost, in particular due to the further machining processes mentioned above (such as grinding or even machining) after the manufacture of the blank.

For a small drum card in particular it is feasible to produce a (rotary) body using fibre reinforced synthetic materials which can be applied without further processing of the bore as a card drum which meets the highest requirements. The term "card drum" in this context comprises the card main drum as well as the other drums or rolls such as e.g. the licker-in or the take-off roll. Fibre reinforced synthetic materials represent compounds or "composites" of e.g. glass fibres and a resin, the E-modulus of e.g. glass fibre filaments exceeding 70,000 $N/mm^2$ and the E-modulus of a polyester resin being merely of about 3000 $N/mm^2$. The reinforcing fibres can be applied in the form of "endless" filaments and/or of staple fibres of various staple lengths and/or in the form of a "fabric" (e.g. a woven fabric). Various manufacturing methods (e.g. injection moulding or casting of a fibre/resin compound) are suitable for producing elements from fibre reinforced synthetic materials.

In contrast to conventional materials such as steel or cast iron a compound material is anisotropic (non-isotropic material). If such materials are used it is not possible to just "copy" a conventional carding roll, in particular a carding main drum. The reinforcing fibres thus should be arranged selectively in such a manner that a specific performance of the final product can be achieved, especially for fulfilling predetermined minimum requirements of selected product characteristics. The selection of properties for which minimum requirements are set thus is of great importance.

The reinforcing fibres in a carding roll (particularly in a carding main drum) made of fibre reinforced material thus should be present in the form of a structure extending in circumferential direction. The arrangement can be laid out in such a manner that e.g. a carding drum within a predetermined range of rotational speeds is subject to an increase in diameter of less than 10, preferably of less than 5 hundredths of a millimeter.

As reinforcing fibres "endless filaments" (e.g. "glass fibre rovings") may be used but also fibres in the form of a batt or a fabric could be applied. The orientation of the reinforcing fibres in the final product is important for achieving the required resistance against deformation (expansion of the diameter) under the influence of centrifugal forces. The geometry of the structure (particularly of the wall thickness) as well as the type of fibre used (kind and type of fibres) and the fibre content (the quantity or contents proportion of the reinforcing fibres) in the compound material also exert their influence as well as possible filler and modifier materials. If glass fibres are used, a glass content in excess of 50% is chosen preferentially. The matrix (binder) material still must be able to effect the required cohesion of the compound material also under deformation, or under the influence of stress, respectively. A glass content of about 50 to 70% should yield a sufficient E-modulus at acceptable wall thicknesses.

Instead of glass fibres also other reinforcing fibres could be used such as carbon fibres or aramid (aromatic polyamide) fibres. Such newer types of fibres, however, still are quite costly and their use in the application described here is not indicated, as less expensive glass fibres can lend the required stiffness and strength to the product.

The matrix material is to present a certain toughness, particularly against deformation cycles (repeated deformation, followed every time by a return to the initial state). Special care is to be taken that deformations may be caused also by expansion of the material under the influence of heat, under which conditions within the presumed range of temperature changes the resin applied is not to soften nor to become brittle. Duromers (e.g. a polyester resin or an epoxy resin) may be applied but not a thermoplastic material.

The pre-selected compound material (or its components) preferentially are processed to form a substantially tubular body to be combined with other elements but which, for the application as a card drum, does not require substantial further processing as such. This body can be of an axial length of between 1 and 2 m. The outside diameter preferentially ranges between 700 and 900 mm. The wall thickness preferentially ranges from 10 to 30 mm (e.g. 15 to 20 mm) and preferably is maintained substantially constant over the full length of the body. A body of the type mentioned can be formed using the winding method which yields very small eccentricities, or very low out-of-round deviations respectively, without requiring any of the further processes mentioned before.

At given drum dimensions the mass of a body of this type will be much smaller than the mass of a corresponding body made from conventional materials owing to the relatively low density of the compound material in comparison to steel or cast iron. The density of the compound material can be e.g. about 1.4 $g/cm^3$ Considerable advantages result from this, concerning the moment of inertia (resistance against acceleration and deceleration), speed-up and slow-down time periods required, and the power requirements of the drive.

The tubular body preferably is of constant external diameter over its length, i.e. this body, other than a pressure vessel, is not provided with end portions extending radially inward. The end portions of the body thus preferentially are connected with support members (drum discs or bases) each of which can comprise a hub, spokes and a rim portion. The rim portion is connected with the body made from compound material e.g. by means of an adhesive whereas the hubs can take up a support shaft, or a drive shaft respectively. The end surfaces of the body could be formed by cutting a body produced to a (slightly) longer length. According to the preferred solution, however, the end surfaces of the body are formed together with the main portion of the body.

To form an operational card drum, the outer cylindrical surface of the body is to be provided with a clothing, which in a conventional card is effected by winding a "wire" onto the drum. The same procedure for mounting the clothing also can be applied in the case of a card drum according to the present invention, in which arrangement preferentially at a given operating rotational speed the pressure exerted by the wire-winding procedure onto the compound material compensates the tensile tension generated in the same material by the centrifugal forces to a large extent. This permits reaching a state at which the tensions generated in the compound material always remain below the permanent strength of the material. The stiffness of the drum support discs preferably is adapted to the stiffness of the tubular body in such a manner that the drum under the influence of the centrifugal forces is deformed as uniformly as possible over its whole length (and in any case over its working width), and over the whole circumference, respectively. The stiffness of a drum support disc of a card drum made from fibre reinforced synthetic material thus should be reduced in comparison to the stiffness of a support disc for a steel or cast iron drum. Care must be taken that the drum support discs do not develop (natural) resonance vibrations within the range of operating rotational frequencies.

It is an advantage of a compound material of the type described that it presents dampening properties. These characteristics are not of prime importance in the design of a carding main drum or roll but they could be taken into account as a beneficiary side effect once the main requirements are met.

A revolving flat card according to the present invention furthermore can be characterized in that the revolving flats can be adapted to the dimensions of the main carding zone. This adaptation can comprise the following measures (to be taken individually or in combination):

1. The width of the flat bar does not exceed 27 mm.

2. The clothing of the revolving flat is divided into groups of points each group preferentially forming a "carding line".

3. The points of the flat bar clothing are arranged on an envelope surface which is adapted to the corresponding circumferential surface of the main drum clothing (e.g. using a curvature of the envelope surface of the revolving flat clothing).

4. The clothing of the flat bar is divided into groups of points, the points of the different groups differing in strength.

5. The clothing of the revolving flat is divided in groups of points in which arrangement the different groups differ in point density.

6. The clothing is mounted onto the flat bar in such a manner that substantially the whole working surface facing the main drum in the main carding zone is provided with points. A proposal for effecting this measure is contained in the Swiss Patent Application No. 1548/97 dated Jun. 26, 1997 by the same applicant and will be described in the following in more detail.

The invention according to CH 1548/97 provides a flat with a flexible, or with a semi-rigid clothing. For the sake of simplicity the term "flexible" clothing only is used, which in this context is understood to comprise the "semi-rigid clothings" too.

A flat according to CH 1548/97 is characterized in that at least one edge zone adjacent to the longitudinal edges is provided with points. Preferably both edge zones are covered with points. The present invention of course comprises a revolving flat arrangement with a plurality of such flat bars and a card provided with a revolving flat assembly of the type mentioned.

The invention according to CH 1548/97 also comprises a corresponding flexible clothing with a base, characterized in that at least one edge zone adjacent to the longitudinal edges is provided with points.

The invention according to CH 1548/97 can be implemented in many different manners. Thus e.g. clip elements can be provided with points. The clip elements, however could be provided with holes in such a manner that points supported by the base can protrude via the holes. In another alternative solution the method of mounting the clothing could be changed basically, e.g. by adhesively fastening the base to the support surface on the flat.

Design examples according to the present invention are described in more detail in the following with reference to the illustrations shown in the Figures.

BRIEF DESCRIPTION OF THE DRAWINGS

FIG. 1 a schematic side view of a card which could be designed according to the present invention or conventionally; this Figure serves mainly for the identification of the working elements and working zones of the card, FIG. 2 a schematic view to a much enlarged scale of the clothings facing each other on the card according to the FIG. 1, FIG. 3 a schematic view of the card according to the FIG. 1 together with its feed system and its take-off system, FIG. 4 a schematic view of a portion of the main drum of the card according to the FIG. 1 including its wiring (clothing); this Figure serves mainly for explaining the term "working width", FIG. 5 a schematic view of the preferred solution, FIGS. 6 through 9 Copies of the FIGS. 8 through 11 from EP-A-627 507 with a profile to be applied in a flat according to the present invention, FIG. 10 a schematic view of the foot portion of a profile according to the FIGS. 6 through 9 with an alternative clothing type according to CH 1548/97, i.e. according to the measure No. 6 mentioned above, FIGS. 11 through 15 corresponding schematic views of the relevant elements of alternative examples according to CH 1548/97, FIG. 16 a detail each of a revolving flat assembly with flats according to the measure No. 1 mentioned above, FIGS. 17A through E a schematic view each of design examples of a flat, changed according to the measure No. 2 mentioned above, FIG. 18 a schematic view of a flat changed according to the measure No. 3 mentioned above, FIG. 19 a schematic view of a flat changed according to the measure No. 4 mentioned above, FIG. 20 a schematic view of a flat changed according to the measure No. 5 mentioned above, FIG. 21 a schematic view of a first alternative manufacturing method for a main drum according to the present invention, and in the FIG. 21A a detail according to the FIG. 21, FIG. 22 a schematic view of a second alternative manufacturing method, FIG. 23 a schematic view of elements of the preferred design of the main drum of a card according to the FIG. 5 the cylindrical portion being shown in a cross section, and in FIG. 24 a schematic view of the end portion of the drum according to the FIG. 23 seen in the direction of the arrow P.

DETAILED DESCRIPTION

Figure 4:
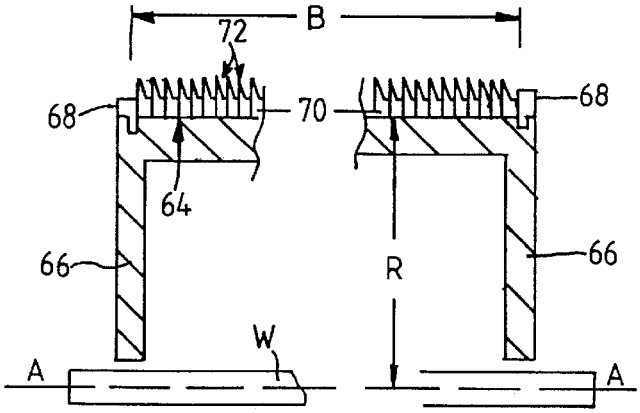
Fig. 4 PRIOR ART

In the FIG. 1 the main working elements of a revolving flat card are shown. The machine comprises one single main drum 50 (card cylinder) which is rotatably supported in a frame (not shown in the FIG. 1). In the FIG. 1 the drum is assumed to rotate clockwise. The main drum 50 co-operates with three further working elements, namely:

an assembly 52 of revolving flats, i.e. the design according to the FIG. 1 does not represent a card (or long staple card) provided with carding rolls or with stationary carding plates as main working elements, a fibre feed system 54 (FIG. 3) comprising in particular a feed roll 56 and a licker-in 58, and a fibre take-off system 60 comprising in particular a so-called take-off roll (or doffer roll 62).

The arrangement according to the FIG. 1 is shown as an example merely. The characteristics to be described in the following also can be applied in other card types and in long staple cards, even in the large machines used in manufacturing nonwovens (non woven fabrics). The revolving flat assembly 52 comprises flats 53 of which only a few individual flats are indicated in the FIG. 1. The revolving flat arrangement currently used on the revolving flat card of the type C50 built by Maschinenfabrik Rieter AG comprises more than a hundred flats 53. The flats are supported at their respective ends by endless tapes or belts (not shown) by means of which they are moved against the direction of rotation of the main drum or in the same direction. Examples of such arrangements are shown in EP-A-753 610.

The portion HKZ of the drum circumference covered by the revolving flat assembly 52 can be referred to as the main carding zone. In this zone the major part of the carding work is performed. Further working elements, however, can be provided additionally in other zones of the main drum in order to effect a further carding effect there. The portion VKZ of the drum circumference between the licker-in 58 and the revolving flat assembly 52 in this context is referred to as the pre-carding zone, and the portion NKZ of the drum circumference between the revolving flat assembly 52 and the take-off roll 62 is referred to as the after-carding zone, and the portion UKZ of the drum circumference between the take-off roll 62 and the licker-in 58 is referred to as the under-carding zone. In the pre-carding, the after-carding and the under-carding zones slat-shaped elements 55 (FIG. 3) can be arranged, the arrangement of such elements in the under-carding zone preferentially being dispensed with.

In the FIG. 4 a portion of the main drum 50 is shown with its cylindrical surface 64 and with its drum discs (bases) 66. The surface 64 is provided with a clothing which in the example shown is provided in the form of a wire 70 with a saw tooth profile 72. The saw tooth wire 70 is wound onto the main drum 50, i.e. is placed in windings tightly side by side between lateral flanges 68 (FIG. 4) in such a manner that a cylindrical "working surface" studded with points is formed. The axial dimension B of this working surface can be referred to as the "working width". On the working surface the work, i.e. the processing of fibres, is to be performed as uniformly as possible.

In the FIG. 2 a detail, e.g. at the point I in the FIG. 1, is shown to a much enlarged scale. The wire 70 and two of its saw teeth 72 are shown again here. In the FIG. 2 also a portion of the flat 53 is shown which facing the surface 64 forms the "working gap" AS. The flat 53 is shown with a clothing in the form of a portion of a length of wire 71 with saw teeth 73 also, alternative preferred solutions being described in the following. The carding work is performed between these clothings and is influenced substantially by the positions of the clothings relative to each other as well as by the clothing distance "e" between the points of the teeth of the two clothings.

The working width B of the main drum 50 is decisive for all other working elements of the card, in particular for the revolving flats (or fixed flats in a fixed flat card) which in co-operation with the main drum are to card the fibres uniformly across the full working width B, the feed system which is to continually ensure an evenly distributed fibre stream fed to the main drum over the full working width B, and the take-off system which continually is to take off fibres from the main drum 50 over the full working width B.

If the carding action is to be performed uniformly across the full working width B, the settings of the working elements (including also the settings of any additional elements) are to be maintained constant across the full working width B. The main drum 50 itself, however, can be subject to deformations caused by the winding on of the clothing wire, by the centrifugal forces and by the heat generated by the carding process, additional stiffness being obtainable at the cost of additional material (wall thickness).

In the FIG. 4 also the shaft W of the main drum 50 is shown. This shaft W is supported in a machine frame (not shown) in such a manner that the main drum can be rotated about the longitudinal axis A—A of the shaft W driven by a drive arrangement (not shown). The diameter (Ø) of the cylindrical surface 64 (i.e. twice the radius R shown) is an important dimension of the machine. According to the present invention the diameter (Ø) ranges between 700 mm and 1000 mm, a diameter between 750 mm and 850 mm being chosen preferentially. The preferred range of diameters is 800 mm to 820 mm.

Furthermore the card according to the present invention presents a working width exceeding 1300 mm and preferably of 1500 mm.

The reduction of the main drum diameter, the circumferential speed being maintained constant, results in increased centrifugal forces which yields improved separation of heavier particles. The reduction of the working surface, and the reduced number of working elements respectively, on the main drum incurred with the reduction of the diameter can be offset at least partially by the increased centrifugal forces. Owing to the reduction of the main drum diameter furthermore the heat generation and the corresponding expansion are reduced which permits more precise settings of the working elements to be reached and thus better carding performance to be achieved. Owing to an increase in the working width production rates substantially in excess of 100 kg/h can be reached.

The stress (load) to which the fibres are subject predominantly depends on the relative speeds of the working elements which (particularly relative to stationary working elements) in turn depend on the circumferential speed of the main drum. The total stress acting on the fibres should not be substantially increased over the stress exerted by current conventional cards which to some extent can be effected in that the number of working elements provided along the circumference of the main drum is reduced.

Generally it proves advantageous if a "small" card (provided with a small diameter main drum) is driven at a somewhat higher circumferential speed than applied in processing the same fibre blend in a conventional card at the same production rate. The drive arrangement (not shown) is to be laid out correspondingly. The circumferential speed of a (currently) conventional card (under normal operating conditions) is chosen in the range of 20 to 40 m/s which corresponds to a rotational speed of 300 to 600 revs. per minute. In order to maintain this circumferential speed in the new (smaller) card the main drum is to be driven at a rotational speed ranging from 500 to 1000 revs. per minute. Preferentially the drum is laid out to be driven at still higher speeds without causing problems concerning strength, stiffness, or vibrations. The increased centrifugal forces, however, also induce a higher risk of losses of good fibres. In order to counteract this risk a clothing with a greater "grip" is to be used on the main drum in such a manner that (compared to the situation on the conventional card) the fibres are held "tighter" on the clothing.

The main drum preferentially is provided with a clothing the point density of which is higher than 900 points per square inch, e.g. 950 to 1050 points per square inch. The point density can possibly be still further increased, e.g. to approximately 1100 points per square inch. This clothing preferentially is of the type provided with an "aggressive" breast angle (according to DIN 64123) preferentially with a breast angle noticeably exceeding 30°, e.g. of 40° or more (compare "Die Kurzzstapelspinnerei/Short Staple Spinning": vol. 2—"Putzerei und Karderie/Blowroom and Carding", p. 54; by W. Klein; ed.: The Textile Institute, Manchester). The breast angle can be increased still further, e.g. it can lie in the range of 35° to 45° or even 500.

Figure 3:
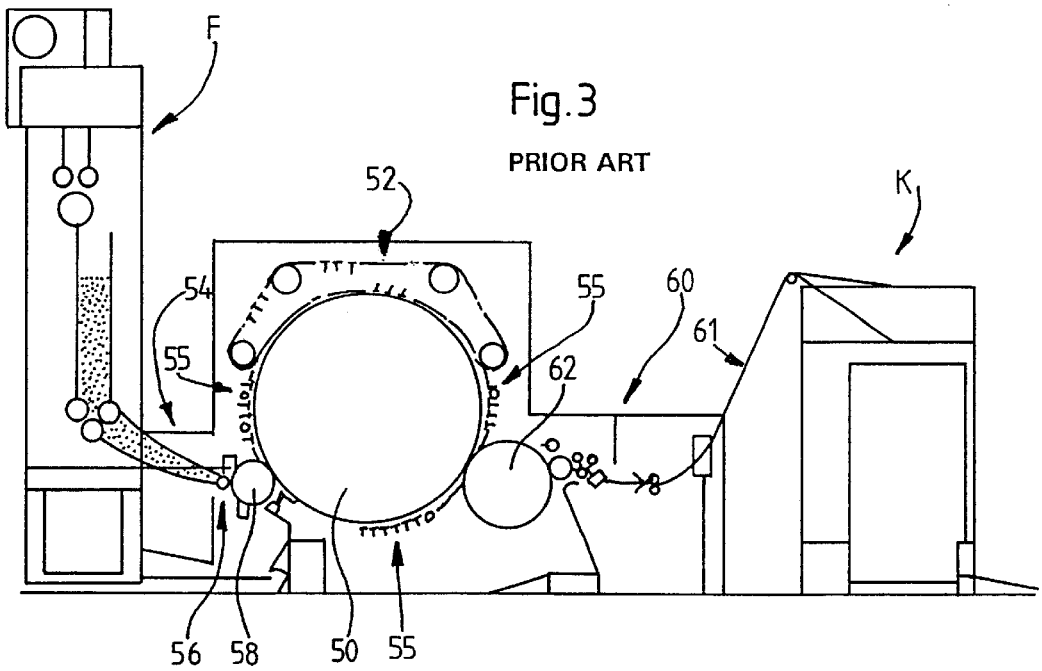
Fig. 3 PRIOR ART

The single licker-in (taker-in) 58 according to the FIG. 1, or to the FIG. 3 respectively, can be replaced by a plurality of licker-in rolls, e.g. according to the principles explained in DE-A-33 46 092, and DE-A-43 31 284 respectively. If an arrangement of this type is used the degree of opening of the fibre material can be enhanced before it reaches the main drum.

In a revolving flat card the number of flats and their bending resistance are of great importance. The preferred solution comprises at least 20, and preferentially at least 25 flats in their working position, i.e. in their position in which they exert a carding effect in co-operation with the main drum. In order to reach this number in spite of the reduction in diameter of the main drum the width (seen in the direction of movement) of each flat can be reduced in comparison to the current conventional value, e.g. from about 35 mm to less than 30 mm or even less than 27 mm. This reduction today is favoured by the profile manufacturing technology available, i.e. the narrower flats (supporting the clothing) can be designed as hollow profiles. These flats can be designed e.g. according to U.S. Pat. No. 5,230,135. Alternatively they can be made from fibre reinforced synthetic material as proposed also in DE 27 42 420.

The "size" (the angle enclosed at the rotational axis) of the under-carding zone preferentially is reduced to a minimum as explained in the following with reference to the FIG. 5. In this Figure the main drum 50, the licker-in 58 directly co-operating with the main drum, and the take-off roll 62 (compare the FIG. 1) are shown. This arrangement differs from the one shown in the FIG. 1 in that the angle $\alpha$ enclosed at the axis of rotation A between the radii R1, R2 connecting the axis A with the rotational axes of the licker-in 58, and of the take-off roll 62 respectively, has been reduced. The under-carding zone UKZ thus is just large enough to permit installation of the following devices, namely:

- suitable guide elements L (indicated schematically only) at the point of transfer from the licker-in 58 to the main drum 50, and
- the "tongue" Z (e.g. according to EP-A-790 338) in the transfer zone between the main drum 50 and the take-off roll 62, and
- a clothing grinding device GSV (e.g. according to U.S. Pat. No. 5,355,560) which is not essential for the actual function of the card and thus can be considered as a non-compulsory option.

An angle $\alpha$ of 90° at the most and preferably of 60° to 75° is sufficient for the purpose mentioned above.

The ratio of the diameter D of the main drum 50 to the diameter d of the take-off roll 62 also is an important characteristic of the preferred design example of the new card. This diameter ratio preferentially ranges from 1.1 to 1.8 and thus is noticeably lower than the corresponding ratio in conventional cards.

Figure 5:
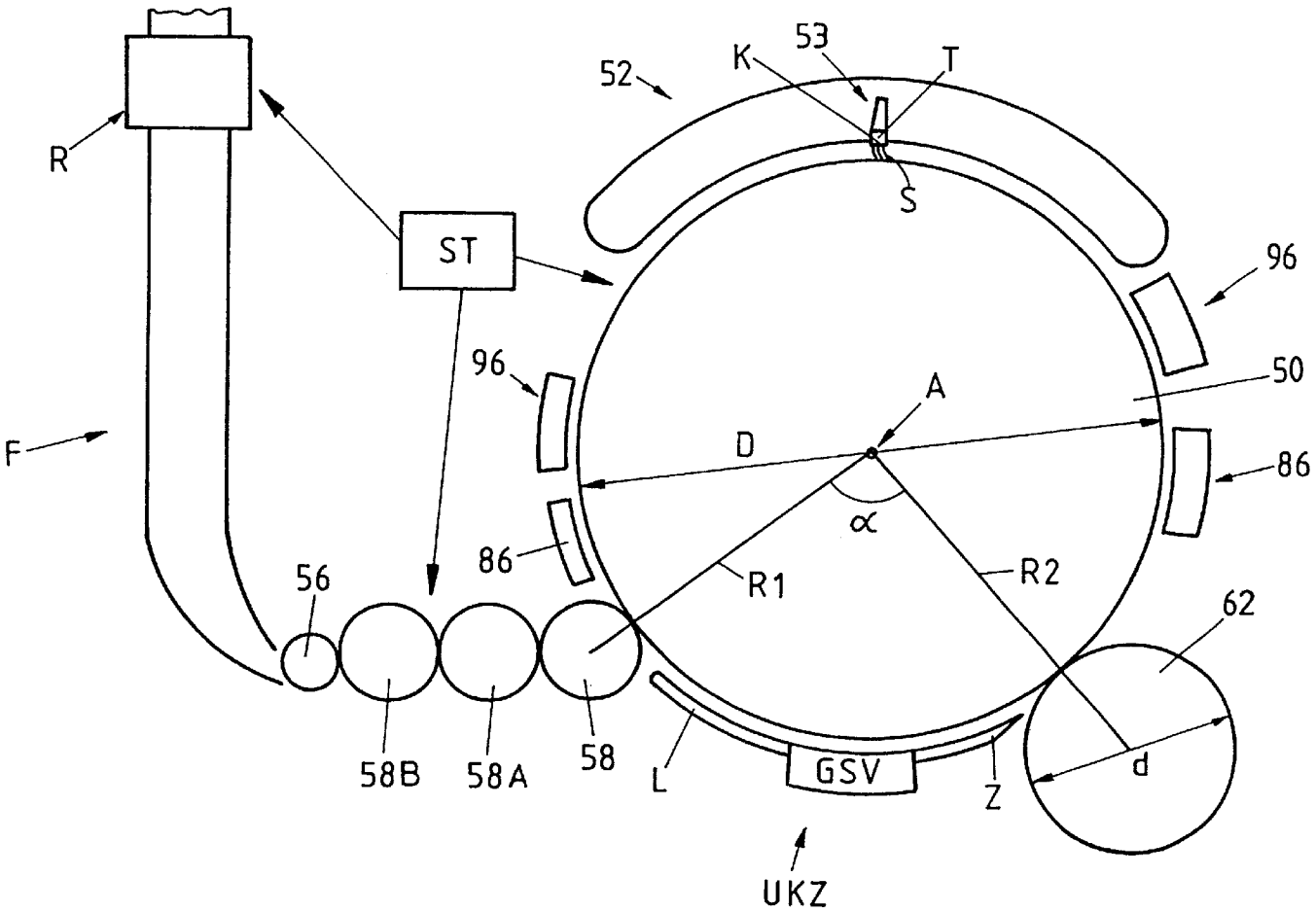
Figure 6:
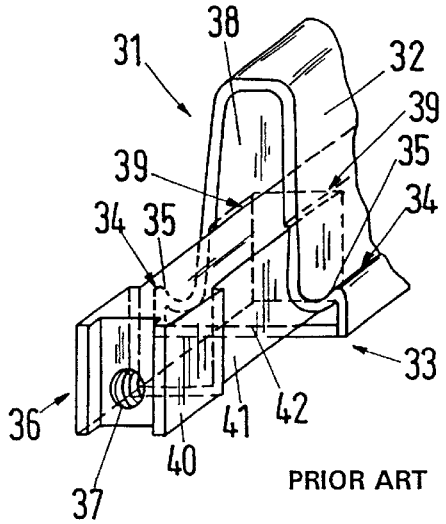
Figure 7:
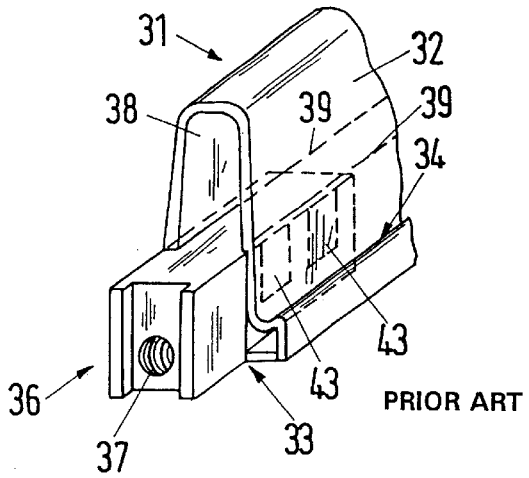
Figure 8:
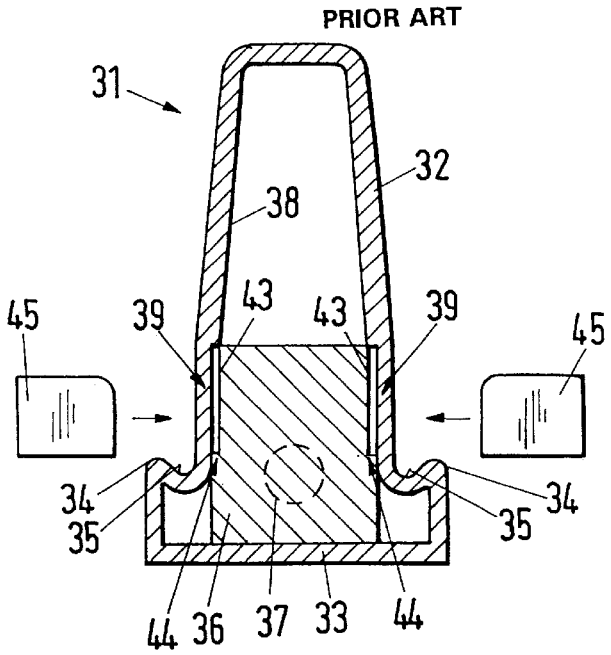
Figure 9:
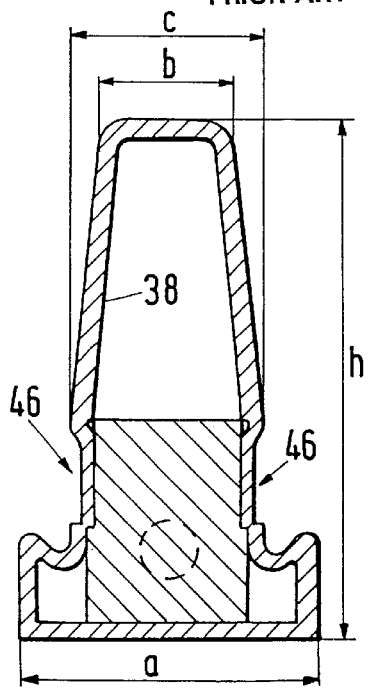

The solution according to the FIG. 5 comprises three licker-in rolls 58, 58 A and 58B. The last mentioned licker-in 58B co-operates with the feed roll 56 which takes over the fibres in the form of a batt formed by the feed chute F (compare the FIG. 3). The chute according to EP-A-810 309 preferentially also is equipped with a cleaning device R. The card and the feed chute preferentially are provided with a common control device St.

The revolving flat assembly 52 shown in the FIG. 5 comprises about 70 to 90 flats 53, of which about 20 to 35 flats simultaneously are in their working position facing the main drum 50. In the FIG. 5 only one flat 53 is shown, at an "oversize" scale, the following elements of the flat being rendered visible. Each flat 53 preferentially comprises a clothing support T shaped as a hollow profile as shown also e.g. in U.S. Pat. No. 5,542,154. The clothing strip fastened to this support member T preferentially is designed as a flexible ("semi-rigid") clothing, i.e. the strip comprises a flexible body K fastened to the support member T and individual points S parts of which are embedded in the body K.

The revolving flat assembly 52 can be replaced by fixed flats, e.g. according to the principles explained in U.S. Pat. No. 3,604,062; U.S. Pat. No. 3,044,475 and U.S. Pat. No. 3,858,276.

In the pre-carding zone at least one additional segment 96 with a waste separator knife (not shown—e.g. according to the European Patent Application No. 97810695.3 dated Sep. 22, 1997) finds room. In the after-carding zone in most cases an additional segment 96 or carding slats (not shown) are provided which can be designed similar to the flats 53. A plurality of additional segments 96 each can be provided in the pre-carding zone as well as in the after-carding zone.

The main drum 50 otherwise is covered by segments 86. The inner surfaces of these covering segments 86 facing the main drum can be finished, or treated respectively, in such a manner that they exert as little braking or slow-down effect as possible on the fibres touching them. These segments also must be adjustable with respect to the main drum 50 in such a manner that they ensure that the fibres are guided as desired and that they ensure the pre-determined air flow conditions near the main drum. A cover suited to these tasks is described in EP-B- 431 482, and EP-B-687 754 as well as in EP-A-790 338. The cover segments, and the additional segments 86, 96 respectively, are indicated schematically merely in the FIG. 5. The segments preferentially form a continuous cover for the main drum.

In order to adapt the sliver weight at the delivery end of the card optimally to the subsequent process the card can be equipped additionally with a drafting system arranged in the delivery train to draft the collected web 61 (FIG. 3) by a factor 1.3 to 4.0, possibly even to 6.0. This drafting system additionally can be equipped with an evener device, e.g. according to CH 153/97 dated Jan. 23, 1997 or (preferentially) according to the German Patent Application No. 197 38 053 filed Sep. 1, 1997 by the applicant, for improving the evenness of the sliver. Alternatively a drafting system can be provided on the coiler arrangement (not shown in the FIG. 5, but compare the coiler arrangement K' in the FIG. 3).

The reduction in diameter of the main drum according to the present invention would result directly in a reduction of the working area if no countermeasures would be taken. The reduction of the working area can be compensated for partially at least if the working width is enlarged. The design of the revolving flats, however, will be of great importance in a small main drum card. Suitable design examples thus are to be explained in more detail in the following with reference to the FIGS. 6 through 20.

In the FIGS. 6 through 9 a known flat profile 31 is shown which also could be applied to a card according to the present invention. This profile comprises a spine part 32 and a clothing support portion (a "foot" portion 33). The foot portion comprises two projections 34 with fixation surfaces 35 sloping inwards. At the outer ends of the flat bar head elements 36 are arranged one of which only is visible in the Figures. Via these head elements each flat bar is connected to a chain drive or a belt drive (not shown) in the revolving flat assembly, e.g. according to EP-A-625 507. As the connection with this drive arrangement is of no consequence within the scope of the present invention, it is not described further here. The FIGS. 6 through 9 also show further details concerning the connection structure (37 through 46) of the profile to the head elements which also are not of importance for this invention and thus are not described further here.

The basic principles of clothing conventional cards are described in "Handbuch der textilen Fertigung (Handbook of Textile Manufacturing), vol. 2; Putzerei und Karderie (Blowroom and Carding)" (Authored by W. Klein, edited by the Textile Institute, Manchester)—compare in particular page 52 concerning the application of flexible and semi-rigid clothing on flats. The importance of the clothing for the carding performance has been confirmed in the article "Entwicklungen auf dem Gebiet der Kardengarniturkonstruktion (Developments in the Field of Card Clothing Design)" in the journal "textil praxis international", September 1994, pp. 551 through 560.

The patent literature contains many proposals for manufacturing flats with clothings composed of saw-tooth strips—compare e.g. EP-A-638 672. The preferred flat clothing, however, still remains the flexible or semi-rigid clothing as described by Klein. This type clothing, however, shows the disadvantage that a clothing strip (the so-called base, normally formed by layers of adhesively interconnected fabrics and studded with points) is to be fastened to the flat bar by means of so-called clips. Thus, even if the width of the support area of the conventional flat is about 32 mm to 35 mm, the width effectively covered by points remains a mere 22 mm approximately (compare Klein, "Putzerei und Karderie (Blowroom and Carding)", page 48). Fastening means of such type are shown e.g. in CH-B-521 454, U.S. Pat. No. 5,095,585, U.S. Pat. No. 4,295,248 and U.S. Pat. No. 3,151,362. If clip-type devices are used the edge zones of the strip along the longitudinal edges are lost as usable area.

Figure 10:
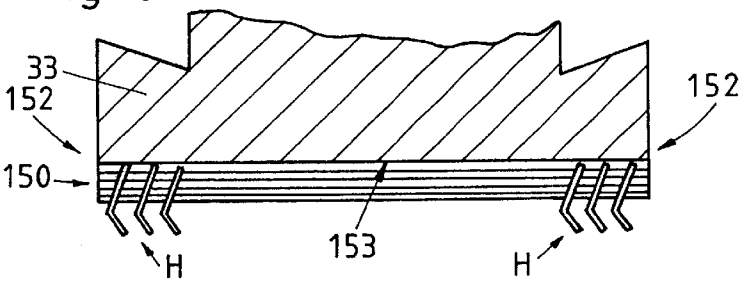

In the FIG. 10 only the foot portion 33 of a profile according to the FIGS. 6 through 9 is shown with a flexible clothing fastened to it which consists of a base 150 and small wires H embedded therein. The base 150 is adhesively fixed to the foot portion and thus is firmly connected thereto. No clips thus are required. The wires thus can be provided also in the edge zones adjacent to the longitudinal edges 152 of the base 150 which was not possible using the clip arrangements applied up to now. For the sake of simplicity in the FIG. 10 the wires H are shown in the edge zones merely but similar hooks of course are to be provided also in the middle portions of the base strip (according to the state of the art). The wires H are not necessarily all identical. Various proposals are known for varying the clothing within a flat which also could be realised here, some examples being described in the following with reference to the FIGS. 17 through 20. For exchanging the clothing the base 150 can be stripped off the foot portion 33, possibly with the help of a solvent which dissolves the adhesive. Onto the well cleaned support area 153 of the profile 33 then a new base 150 can be fastened.

Figure 11:
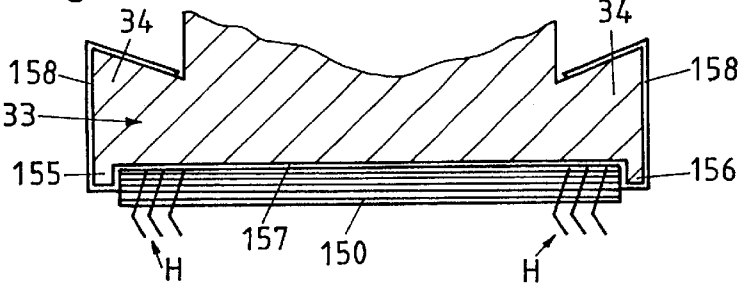

In the alternative design example shown in the FIG. 11 the foot portion 33 is provided with two side walls 155, 156 extending "downward". The base 150 is not directly connected adhesively to the foot portion but is adhesively connected to a flexible tape 157 provided with lateral portions 158 which co-operate like clips with the protrusions 34 of the foot portion in such a manner that the clothing strips are fastened to the profile. The lateral walls 155, 156 can extend downward further as to protect the longitudinal edges of the base 150. The wires H again are shown in the edge zones merely, but they can be distributed over the whole support area of the profile.

Figure 12:
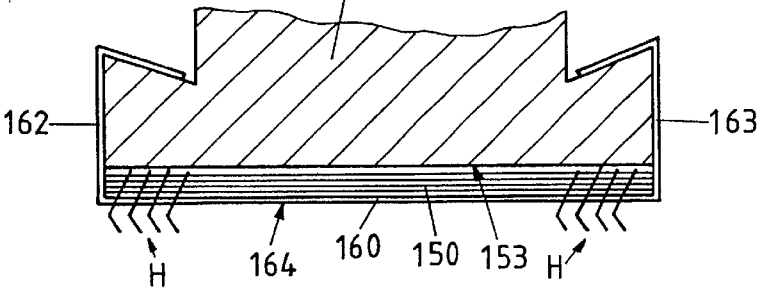

The alternative design example according to the FIG. 12 also comprises a flexible tape or strip 160 with clip-type lateral parts 162, 163. But in this case the base 150 is held between the tape 160 and the support area of the profile 33. The tape 160 thus is to be provided over the whole area 164 with holes (not shown) in such a manner that the wires H embedded in the base 150 can protrude through these holes as shown for the wires in the edge zone as an example.

Figure 13:
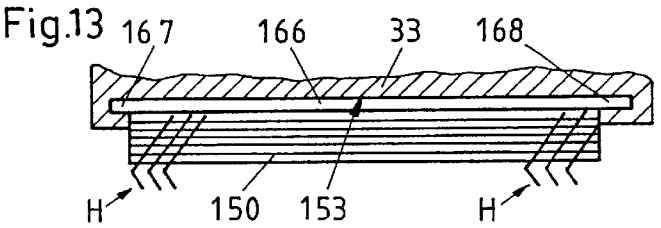

In the FIG. 13 a further alternative design example is shown with a "steel strip sole" 166 on which the base 150 is fastened by any suitable means (e.g. by means of an adhesive). The sole 166 then can be inserted between guide grooves 167, 168 provided in the foot portion 33 of the profile and the base thus is fastened to the profile.

Figure 14:
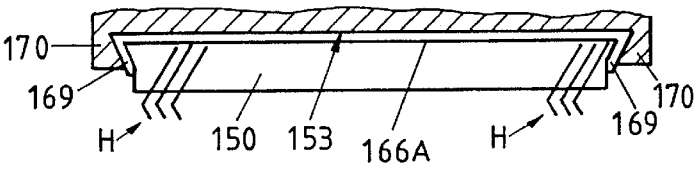

The alternative design example shown in the FIG. 14 closely resembles the one according to the FIG. 13 but the sole 166A is provided with inclined lateral walls 169 which co-operate with correspondingly angled sides 170 of the profile. The base 150 in this alternative design example consists of a rubber-type body in which the wires H are embedded.

Figure 15:
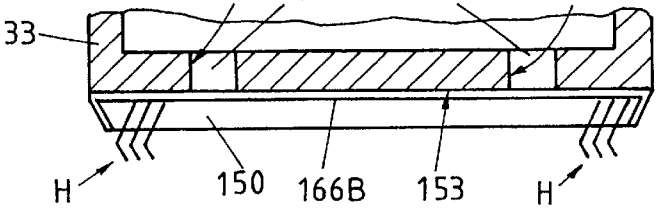

The alternative design example according to the FIG. 15 also comprises a sole 166B with a base body 150 fastened thereto. The foot portion 33 in this case is provided with holes 172 and the sole 166B is provided with corresponding elastic elements 174 which can be taken up in the holes 172 and together they form a snap-on connection.

In the FIG. 16 again the flat 53 (compare the FIG. 5) is shown which in this alternative design example is provided with a "T-shaped" support part T. The envelope surface of the main drum clothing is designated M and the direction of rotation of the main drum is indicated by the arrow P. The illustration shown in the FIG. 16 first is used for explaining certain terms. The term "strip width" is the width of the area on the flat covered by clothing, the "width" of a flat extending in the carding direction, i.e. in the direction P of the rotation of the main drum. The strip width today is chosen smaller than the width TB of the support part (for reasons that were explained in connection with the FIGS. 6 through 9).

Figure 16:
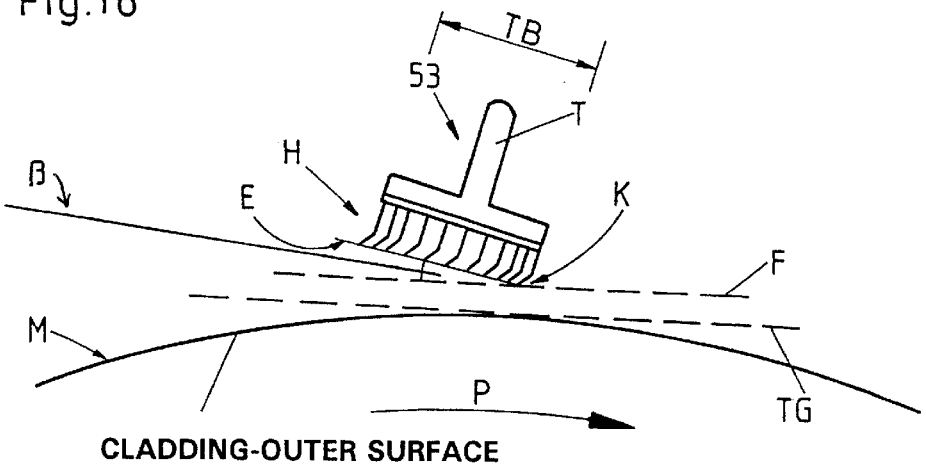

The terms "front" and "back" (and "following") are chosen in the zone of the flats in dependence on the direction of rotation of the main drum rather than with respect to the direction of flat movement. The main drum carries fibres first under (and possibly into contact with) the front edge area of the flat and only subsequently under (into contact with) the back edge area. The contact with the latter area in the arrangement according to the FIG. 16 is ensured as a narrowest location is provided in the back edge area. The flat 53 according to the FIG. 16 can move in the same direction as the main drum or in the opposite direction.

In a conventional flat the "width" TB of the support portion is about 32 to 35 mm. In its working position (in the main carding zone) the flat 53 is guided in such a manner that the points of the wires H are arranged at or in a "clothing plane" E which forms a "narrowest location" or a narrowest carding line with respect to the envelope surface. The plane E together with an imagined plane F encloses an angle β the plane F extending parallel to the tangent TG which intersects the envelope surface M at the narrowest location mentioned before. The wires at, or in the vicinity of, the narrowest location respectively, receive a special grinding finish (the so-called "heel grinding finish").

It is known that not all of the wires H of a flat generate the same carding action and the flats 53 therefore are guided in such a manner that at each flat 53 in the revolving flat assembly an angle β is established. The design of the revolving flat assembly, however, is based on empirical results rather than on theoretical assumptions.

Now it is postulated that the carding action at least for certain types of fibres is influenced by the number of carding lines, in which arrangement the number of carding lines does not depend on the number of rows of wires on a flat, but rather on the number of "edge areas" of a flat. The flat 53 according to the FIG. 16 has two edge areas—a "front" edge area which is relatively distant from the cylindrical surface M and a "following" edge area which together with the cylindrical surface M forms the narrowest location. The wires H between a front edge area and a following edge area following that front edge area, together with the edge areas themselves, form a "point group" corresponding to one "carding line". These concepts correspond broadly with the concepts used in the German Utility 1694956. In a flat 53 according to the FIG. 16 all wires together form a single "point group" or "carding line".

According to the above postulate the number of carding lines (groups of points) should not be chosen below a predetermined value if a certain carding action is to be effected in the main carding zone. The carding action required to be effected in the main carding zone and the number of carding lines required for achieving it depend on the overall design of the card as well as on the production rates to be achieved and thus it is not possible to cite specific numbers which would make sense. It is clear that in case of a reduction in the total carding surface (due to a reduction of the card main drum diameter) an increase in the number of carding lines (groups of points) can be required or may prove advantageous at least.

Thus according to the measure No. 1 mentioned in the introduction the width TB is reduced to a value of 20 mm to 25 mm regardless of whether the flat is designed as a T-profile or as a hollow profile. Owing to this measure a larger number of flats can be disposed next to each other in their working position (in the main carding zone) simultaneously which (with one carding line per flat) results in an increase in the number of carding lines. This measure also can result in a longer lifetime of the clothing on each flat.

An increase of the number of carding lines by subdividing the wires on a single flat into different groups of points already has been proposed in the German Utility Gbm 1694956 mentioned above. An arrangement according to said utility model of course also can be applied to a card according to the present invention. However, FIGS. 17A through 17E show preferred solutions according to the principle proposed in the utility are shown.

Figure 17A:
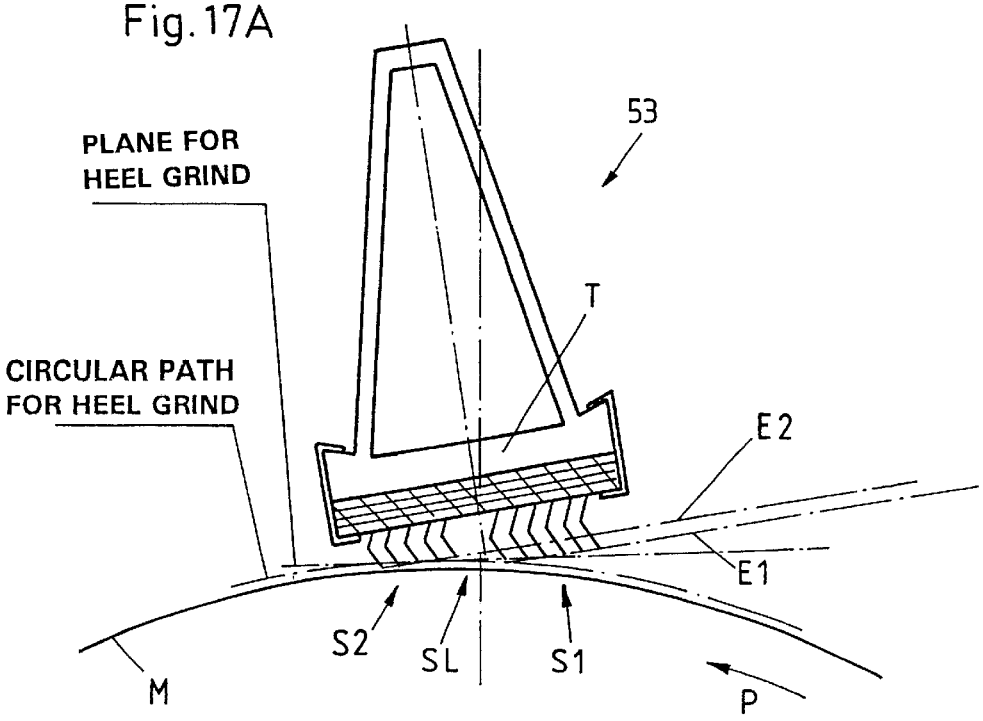

In the FIG. 17A a flat 53 is shown with a support member T designed as a hollow profile which can resemble a conventional support member (e.g. according to the FIGS. 6 through 9). The wires H of the clothing of this flat, however, are subdivided into two groups, the points of the wires of a front group S1 being arranged in a clothing plane E1 and the points of the wires of a following group S2 being arranged in another clothing plane E2. Between the groups S1 and S2 a "gap" SL is provided which lacks wires H. Each of the clothing planes E1 and E2 now presents a respective narrowest location with respect to the envelope surface M and the wires in or at each narrowest location can be subject to the heel grinding finish. For forming the second group S1, S2 wires of different length are embedded. From CH-C-177 219 it is known that carding needles of different length can be used. In that case, however, it was provided that the needles of different length should perform different functions. The points according to the FIG. 17A in principle all fulfil the same function.

Figure 17B:
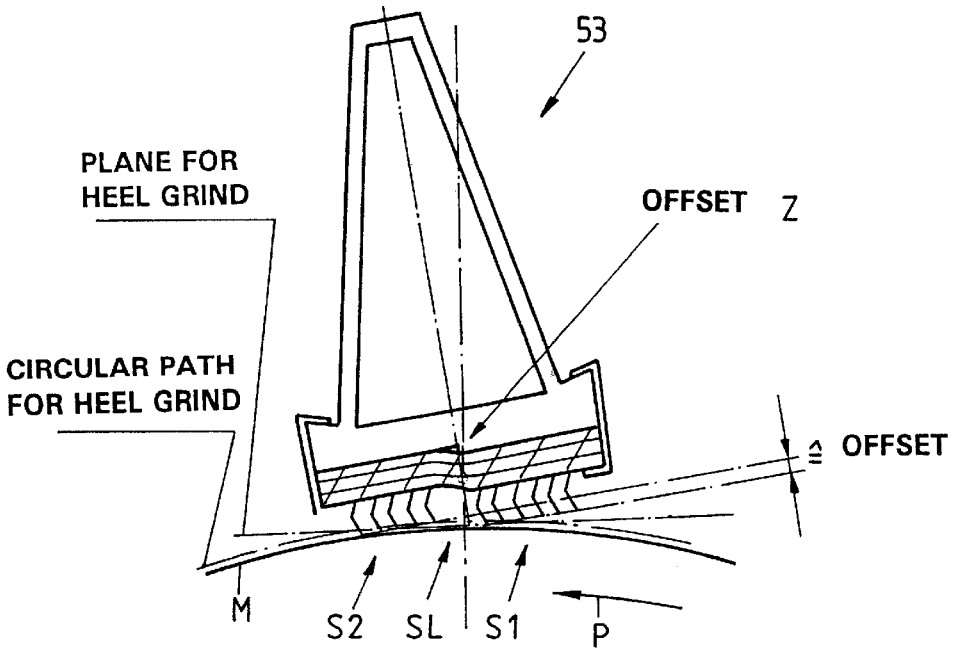

The flat 53 according to the FIG. 17B differs from the one shown in the FIG. 17A in that the support portion T is provided with a step Z. This enables the two groups of points S1 and S2 to be formed using wires all of the same length. The technological effect is identical to the one achieved using the arrangement according to the FIG. 17A.

Figure 17C:
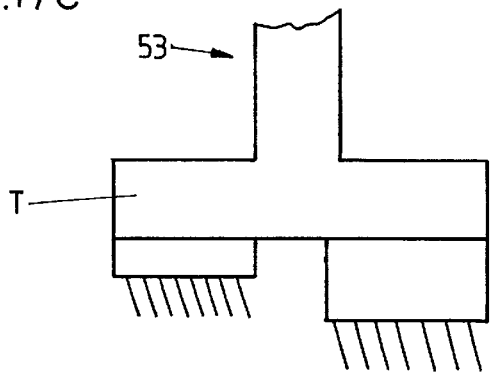

In the FIG. 17C an alternative solution is shown for realising the arrangement according to the FIG. 17B, namely by application of two carding strips on one single support portion T. Each of the strips can be fastened to the support by any suitable fixation means (screws, rivets, adhesives, etc.).

Figure 17D:
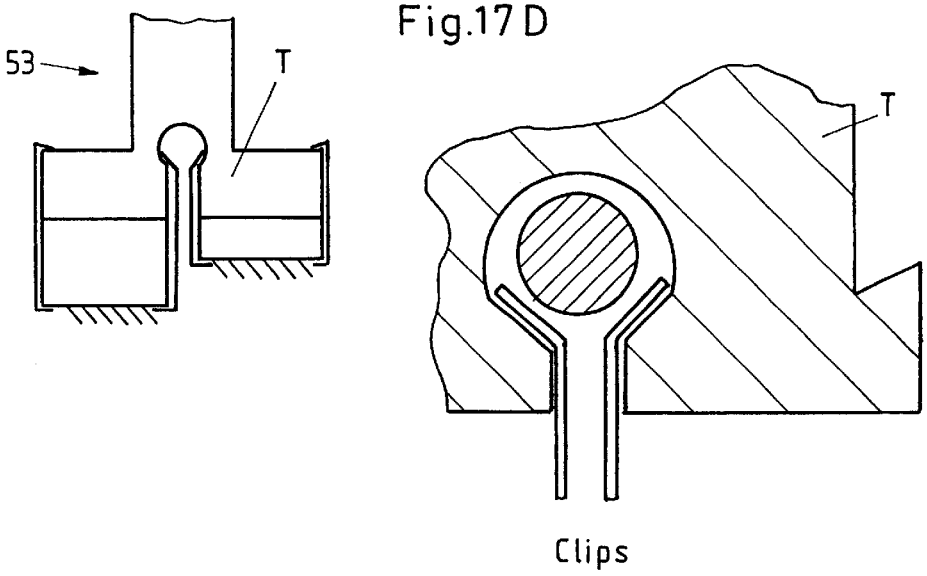

In the FIG. 17D a further alternative solution is shown in which the two strips are fastened to the support by respective cliptype fixation means. The support is provided with a groove N which is enlarged at its inner end in such a manner that the fixation means can be fastened to one "leg" each of the support T.

Figure 17E:
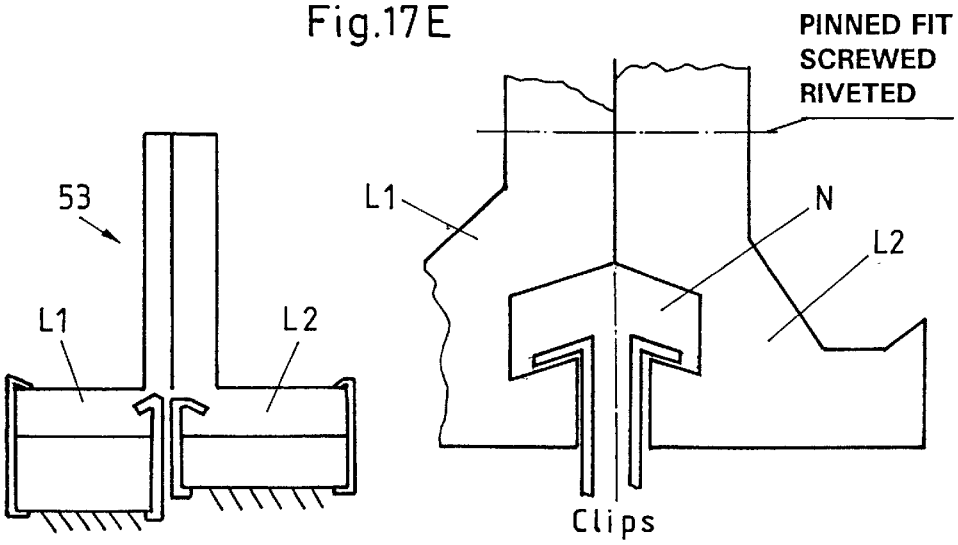

In the FIG. 17E finally an alternative design example is shown with two L-shaped profiles to be joined as to form the support T. This alternative design example can be applied in two different manners namely by using profiles of differing cross-sections (L1 and L2, shown to the left hand side in the FIG. 17E) or by provision of a groove (compare the FIG. 17D) between the two profiles (shown to the right hand side of the FIG. 17E).

In DE-A-28 16 900 a flat is proposed which is conceived to provide an enlarged carding surface. For this purpose the width of the flat is enlarged (in order to reduce "losses") and the working surface of the flat is curved in such a manner that the "clothing area" is adapted better to the envelope surface of the main drum clothing. This proposal also can be applied in connection with the basic invention and could even be combined with the formation of groups, already described, for increasing the number of carding lines. The same principle can be applied in combination with all-steel (rigid) clothings as shown in CH-B-644 900.

Figure 18:
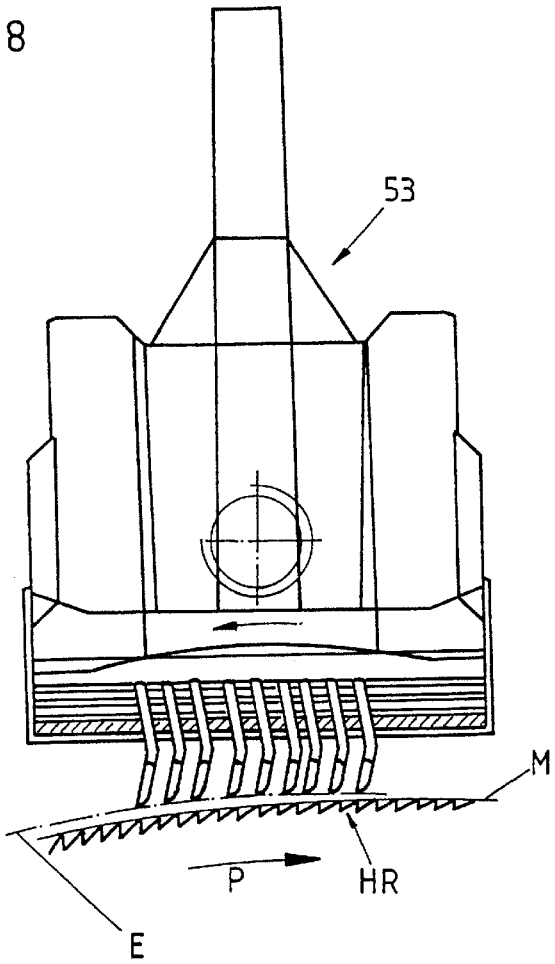

The flat 53 according to the FIG. 18 also is provided with a concave "clothing area" E. In this case, however, the width of the clothing strip is not to be enlarged but the effectiveness of a given strip width is to be improved or optimised (owing to the improved adaptation to the curvature of the envelope surface M). This arrangement even can be combined with the measure No. 1, i.e. the strip width can be reduced in comparison to the current conventional width.

The ideas leading to a solution according to the FIG. 18 are the following:

- The current conventional clothing area extends in a plane and faces the convex envelope surface of the main drum clothing.
- Thus a wedge-shaped gap always is formed between the flat clothing and the main drum clothing.
- The dimensions of this wedge-shaped gap depend on the curvature of the main drum and as known can be modified depending on the operating conditions.
- Adapting the clothing surface of the flat clothing to the envelope surface of the main drum clothing permits achievement of a higher degree of reliability (reproducible performance) of the carding effect in function of a given flat setting.

The last-mentioned idea is valid also if (notwithstanding the curvature of the clothing area) a wedge-shaped gap is to be provided between the flat clothing and the main drum clothing. The curvature of the area E can be chosen e.g. in such a manner that it presents a narrowest gap relative to the surface M in its back edge area HR regardless of whether the diameter of the envelope surface M is minimum or maximum. This arrangement can be combined with the formation of groups, i.e. the clothing area of each group can be formed concave.

A great number of proposals have been made for optimising the arrangement of the individual wires or wire elements in the flat clothing. Examples are:

U.S. Pat. No. 3,808,640 (Graf)—modifications in the "piercing" angle and/or in the "combing" angle over the width of the strip.

DE-Utility 14 86 385 (Seelemann)—the density of the "needling" of the flats is to be chosen lighter than the "needling" of the main drum in which arrangement the flats alternatingly can be provided with greater and with smaller needle density. This latter idea also has been cited in DE-A-22 26 914

The density of points should be varied within a group of points. Variants of this idea are shown in BE-A-588 694; DE-A-26 17 796; DE-A-33 18 580; DE-A-33 36 825; DE-A-41 25 035 and EP-A-431 379 (some of the clothings being provided on fixed flats and in some cases all-steel (rigid) clothings being provided).

These various arrangements also can be used in combination with a card according to the present invention. In the FIG. 19 a further alternative is shown, however, which offers advantages for the design of the new card. In this case the clothing contains (similar to DE-Gbm-1733250 and DE-C-11 06 653) two different thicknesses of wire or wires in which arrangement in the front area VB coarser wires are embedded and finer ones in the back area HB. By the application of "thicker" wires in the front area the lifetime of the clothing can be prolonged which is particularly noticeable at higher production rates. This alternative solution is not limited to the application of just two wire thicknesses, but the additional complexity of finer steps in the grade of wires on a single flat in most cases will not be worth while.

Figure 20:
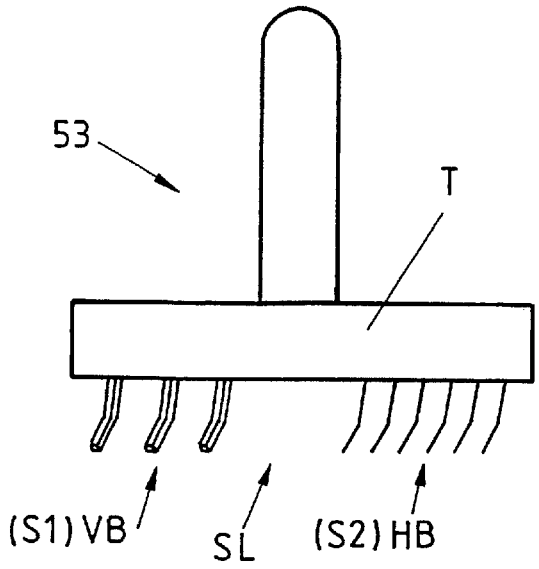
Figure 19:
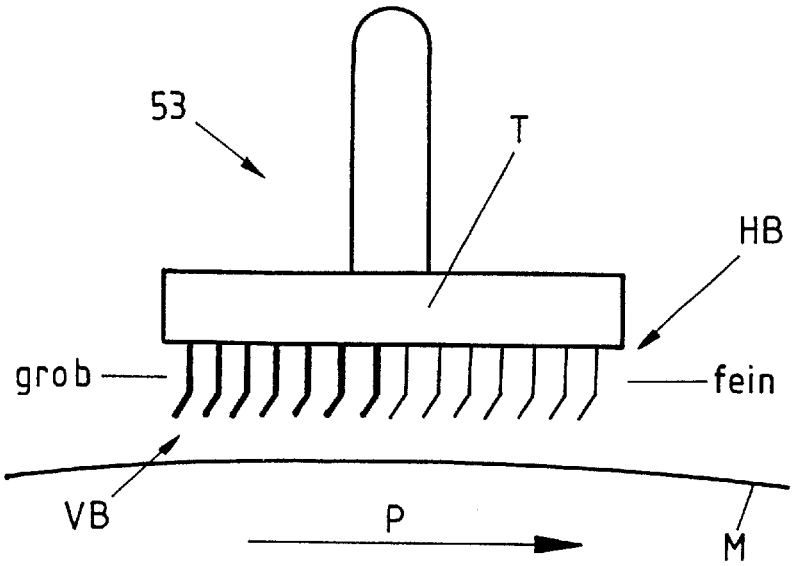

In the FIG. 20 a further alternative design example is shown in which different wire thicknesses are combined with different densities of points according to the proposals already mentioned and in which at the same time the forming of groups described with reference to the FIG. 17 is applied. Of course the clothing arrangement could be laid out also, or alternatively, with a curved clothing surface according to the FIG. 18.

According to a further advantageous design example of the present invention a card main drum made from fibre reinforced synthetic material is to be formed by winding. Thus it can be ensured that the reinforcing fibres in the wound main drum form a structure extending in the circumferential direction of the main drum. With reference to the FIGS. 21 and 22 two possible alternative manufacturing methods are described first. In both alternative methods fibres (e.g. glass fibres) impregnated with resin are wound onto a shaped core 10 which can be removed from the finished product. The core 10 for the winding process is mounted onto a shaft 11 and together with the shaft 11 is rotated about its longitudinal axis by a drive arrangement (not shown).

In the alternative design example shown in the FIG. 21 one end of a filament strand 12 (e.g. a so-called glass filament roving) is fastened to the core 10 (not shown) in such a manner that the filaments are taken from a suitable source (not shown) and are wound onto the core 10 owing to the rotation of said core 10. In order to form spiral or coiled windings around the core 10 the strand 12 is reciprocated by a thread guide 18 to and fro (T) in the longitudinal direction of the shaft 11, in which process the reciprocating speed of the thread guide is controlled in relation to the rotational speed of the shaft 11 in such a manner that a predetermined pitch of the spiral windings results. The pitch can be schematically indicated by a "winding angle" W. The angle W is defined within the context of this description as the angle enclosed between the strand 12 and the tangent line X, the tangent line X intersecting the point of strand deposition P and extending at right angles with respect to the longitudinal axis of the core roll 10. The winding angle is to be chosen small for the following reasons:

i) the resistance of the end product against radial expansion under the influence of centrifugal forces partially depends on the orientation of the fibres—the smaller the angle W, the higher the resistance, and ii) at larger winding angles it is not possible to reverse the movement of the point of strand deposition (where the fibres meet the product) at the edge of the product—winding rather must continue about an edge portion of the core curved inward whereupon the cup-shaped edge portions of the product are to be cut off after winding. A design of this type is undesirable in manufacturing a card main drum but it is not excluded. The preferred method is the one with a small winding angle W in which method the point of strand deposition on the product can be reciprocated at either edge, in which method the points of reversal preferentially are evenly distributed over the circumference of the product.

Before the strand of fibres is wound onto the core it is to be impregnated with a suitable matrix material also called binder material (normally applied in the form of a liquid resin). This is effected in a so-called impregnating device comprising e.g. a resin bath 14 arranged upstream from the thread guide 18 in which arrangement deflecting rolls 16 compel the strand to pass through the bath 14. The bath 14 can be provided together with the thread guide 18 on a movable support member 15 which on a suitable guide member (not shown) is reciprocated by the traversing drive (not shown). The fibre strand 12 preferentially comprises a multitude of "endless" filaments which on the rolls 16 can be spread into a flat tape (FIG. 21) in such a manner that the resin take-up of the strand of fibres is improved. This ensures that every single filament, if possible, is impregnated with the resin and in the impregnated strand is surrounded by resin. The rolls 16 can be designed as barrel rolls (FIG. 21A) which ensure the spreading of the strand of filaments before and during the submersion in the resin bath.

A dancer roll arrangement 20, 22 can be provided upstream of the support member 15 which levels out the path length differences in the strand of filaments with respect to the stationary source (not shown) caused by the traversing movement. But even a movable source could be provided e.g. in the form of a carriage supporting the creel for glass fibre packages and which is moved under control in function of the traversing movement.

The "source" can comprise different types of filaments and thus the fibre strand contains a corresponding "blend" e.g. of relatively cost efficient filaments (such as glass fibres) with relatively expensive filaments (such as aramid or carbon fibres). The "blend" could be changed in the course of the winding process in such a manner that different fibre blends are deposed in different layers of the end product. In the preferred solution only glass fibre is used in which arrangement glass fibre mats or glass fibre fabrics can be inserted in-between the layers of glass fibre filaments. The composition of the resin mix in the bath 14 also can be changed in the course of the winding process. Possible reasons for this procedure are discussed in more detail in the following.

Figure 22:
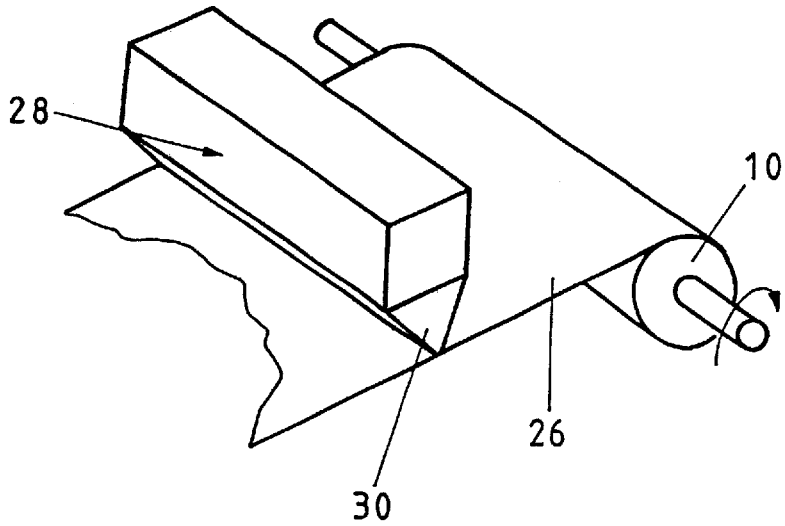
Figure 24:
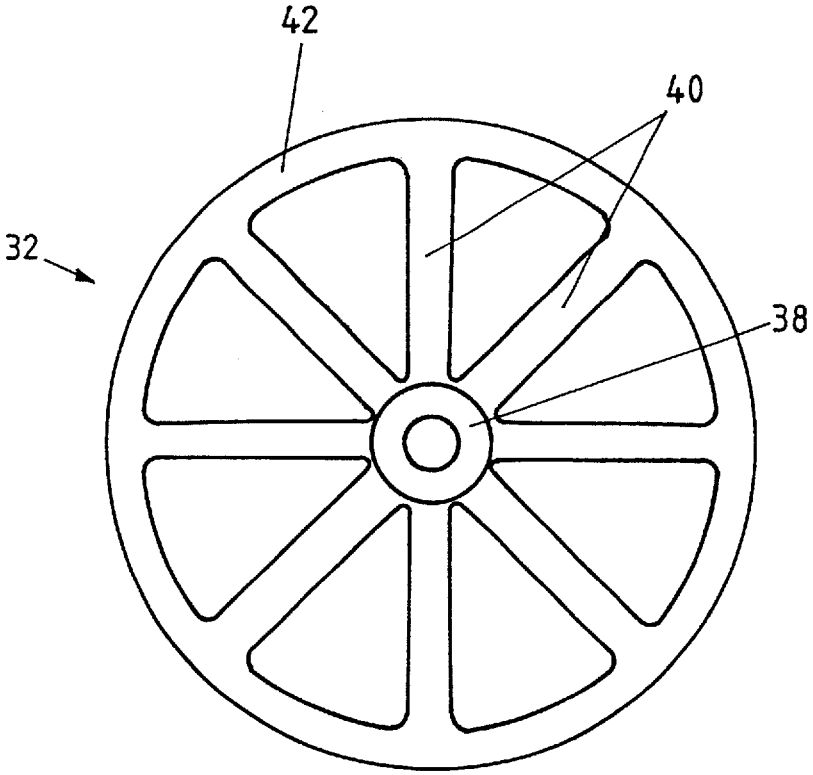

In the FIG. 22 an alternative method is shown for manufacturing a suitable product. In this case a fabric 26 is supplied from a suitable source (not shown) to the winding point and is wound onto the core 10. In the uncomplicated example shown in the FIG. 22 the width of the fabric 26 is adapted to the width of the end product in such a manner that a traversing motion can be dispensed with. This is not mandatory—the fabric 26 could be supplied in the form of a narrow tape (not shown) in which case a controlled to and fro motion would be required in the winding process. Shortly before being transferred onto the core 10 the fabric 26 is guided under a resin supply device 28 with a metering device 30 where the fibres of the fabric are impregnated with resin. It is not necessary that these reinforcing fibres be supplied in the form of a (woven) fabric—a knitted fabric would achieve substantially the same effect. In comparison to the alternative method according to the FIG. 21 the strength of the reinforcing structure is not achieved because of the strength of the individual filaments (fibres) but owing to the strength of the structure resulting from the combination of the fibres.

In both cases (according to the FIG. 21 and the FIG. 22) a fibre structure is generated which extends in the direction of the circumference of the core 10 (and thus in the direction of the circumference of the resulting end product). For achieving this effect it is not mandatory that the winding process be effected continually, nor quasi automatically. Shorter strips even could be superimposed (laminated) onto a mould (similar to the core 10) manually.

However, if the partially liquid fibre reinforced "mass" (blank) is prepared, the resin must solidify before the product can be used as a card main drum. This can be effected in an ageing (maturing) process but preferentially is effected in a heat treatment (curing process) in a suitable oven or autoclave (not shown) at a controlled temperature. In a first hardening step the product can remain on the moulding core, in which case after removal of the core (and possibly after further elements have been fixed to it) a further hardening process can be effected.

The present invention is not limited to the wet winding method described. A dry winding method (prepreg winding) is known in which the reinforcing material is impregnated with resin in a separate process. After a suitable curing process the (still flexible) prepreg is used just like glass rovings in the winding process. This method also can be used for manufacturing a card main drum, it is, however, relatively cost intensive and in this case is not needed for meeting the requirements. Using a method according to the FIG. 21 or the FIG. 22 a tubular element ("tube") can be produced which cannot be used as a card main drum as such. For this application e.g. two end supports 32, 34 (FIG. 23) must be provided which must be connected to the tube 36 in such a manner that a card main drum is completed. Each end support comprises e.g. a hub 38, spokes 40 and a rim 42. The hub 38 is to be connected with a drive shaft (not shown) in such a manner that the drum can be rotatably mounted in the card frame.

The end supports 32, 34 in principle could be made from fibre reinforced synthetic material but preferentially they are made from metal (e.g. forming one piece). The connection with the tube can be effected using e.g. a shoulder 41 which contacts the inner surface of the tube and an end flange fitted against the face surface of the tube. Both end supports 32, 34 can be adhesively connected to the tube 36.

The tube 36 is serving in the card as a support member for a clothing provided e.g. in the form of a wire 70 according to the FIG. 2. It is desirable that working conditions are kept as uniform as possible across the full working width. For this purpose it can prove advantageous to maintain the same wall thickness t over the full length of the tube 36. This may, however, possibly result in differences in the behaviour of the tube 36 over the working width in comparison with its behaviour in the end zones where the tube is connected with the supports. The end portions, where the effects of the end supports are to be expected, can possibly be arranged outside the working width.

As already mentioned with reference to the FIG. 4 the clothing wire 70 is wound onto the support member. Due to the winding of the clothing the tube is subject to pressure. During operation the expansion under the influence of the centrifugal forces generates tensile forces in the tube. By suitably adapting the winding tension in winding the clothing onto the drum and the wall thickness of the drum it can be achieved that at a given operating rotational speed the tensile force generated by the centrifugal forces approximately cancels or off-sets the compression stress generated by the winding on of the clothing. Typical winding forces range from 25 to 100 N, preferentially from 25 to 40 N. Furthermore each end support 32, 34 is to be adapted to the tube 36 in such a manner that the deformation across the width and around the circumference during operation is as homogeneous as possible. Such deformations are generated by the centrifugal forces as well as by the expansion under the influence of heat.

The wall thickness t can be chosen such that the expansion of the tube 36 under the influence of the centrifugal forces but in absence of a clothing is larger than the expansion to which the clothing itself is subject under the influence of the same centrifugal forces. During operation the tube 36 thus can not fully expand as it is restricted by the clothing, the holding force between the tube 36 and the clothing wire 70 being increased.

Means also are to be provided for electrically earthing the clothing wire as the fibres to be processed tend to build up electrostatic forces which can disturb the carding process considerably. For effecting the earthing the wire can be connected with a metallic end support, or an additive ("modifier") can be provided in the resin (e.g. carbon powder) which renders at least the outer layer of resin electrically conductive. The outer layer preferentially is formed by resin or at least contains a high proportion of resin in order to beneficially influence the smoothness of the clothing support area.

For a card a tube 36 can be formed with the following parameters:

| | |
|---|---|
| Length | 1000 to 1500 mm |
| Wall Thickness | 17 to 20 mm |
| E-Modulus | 17,000 to 19,000 N/mm$^2$ |
| Density | 1.2 to 1.6 g/cm$^3$ |
| Inside Diameter | 750 to 850 mm |

This aspect of the present invention has been explained in connection with the description of the manufacture of the card main drum. Evidently the same method can be applied also for manufacturing another card roll (e.g. a licker-in or a take-off roll).

A main drum diameter in the range of 750 mm to 850 mm (e.g. 810 mm to 820 mm) gives an improved (increased) effect of the centrifugal forces (compared with the currently conventional cards), while leaving adequate space to enable mounting of the "counter-elements" (e.g. revolving flats, fixed flats, etc.) relative to the main drum. It is also possible to provide an adequate transfer zone between the main drum and the doffer roll.

A working width in the range of 1300 mm to 1500 mm gives adequate production (output) with the required precision of the working elements taking the high circumferential speed into account.

As already mentioned, it is possible to apply the invention in machines for manufacturing non-wovens. However, the preferred implementation is in the "cotton card" (staple fibre mill). The cotton card is distinguishable from the non-woven card at least in one feature, namely that a sliver must be formed in the delivery section of a cotton card, i.e. the web delivered by the rolls must be drawn or collected together over the working width (or at least a part thereof) to give a sliver.

The machines used in the staple fibre mill can be compared as follows with the machines used for the production of non-wovens:

| | | Staple Fibre Mill | Non-Wovens |
|---|---|---|---|
| (i) | End Product | Sliver | Batt |
| (ii) | Web weight on the doffer roll | 35 to 8 g/m$^2$ | 5 to 15 g/m$^2$ |
| (iii) | Delivery speed | 200 to 400 m/min | 80 to 150 m/min |
| (iv) | Circumferential speed on the main drum | 25 to 40 m/s | 20 to 30 m/s |
| (v) | Effective working gap (e.g. main drum, flats) | ≅ 0.1 mm | ≅ 0.3 mm |
| (vi) | working gap at standstill | ≅ 0.2 mm | ≅ 0.3 mm to 0.4 mm |

In the preferred arrangement the "length" of the transfer zone between the main drum and the doffer roll is not substantially shortened (in comparison with currently conventional cards). This "transfer zone" can be considered as the zone of the main drum circumference where the spacing between the main drum and the doffer roll is smaller than a predetermined value (e.g. 0.2 mm). A reduction in the main drum diameter leads to shortening of this transfer zone if no counter-measures are taken. Therefore, it can prove to be advantageous, to reduce the ratio of the main drum diameter to the doffer diameter in relation to currently conventional values (to increase the doffer diameter at least relatively and possibly even absolutely).

What is claimed is:

1. A carding machine, comprising:

at least one main carding drum having a substantially cylindrical surface with clothing provided thereon defining a working width of said main carding drum of greater than about 1300 mm;

said main carding drum having a diameter between about 700 mm to 900 mm;

a set of flats disposed relative to said main carding drum for uniform carding of fibers on said main carding drum over said working width; and a feeding system disposed to uniformly feed said main carding drum with fibers to be processed over said working width, said feeding system comprising a single transfer location for transferring fibers to said main carding drum.

2. The carding machine as in claim 1, wherein said main carding drum clothing has a point density of at least about 900 points per square inch.

3. The carding machine as in claim 1, wherein said set of flats is a revolving set of flats.

4. The carding machine as in claim 3, wherein said flats have a width of less than about 30 mm.

5. The carding machine as in claim 4, comprising at least about 20 said flats in a working position simultaneously facing said main carding drum.

6. The carding machine as in claim 3, wherein each of said flats comprises clothing divided into at least two clothing groups, each of said clothing groups defining a different carding line.

7. The carding machine as in claim 3, wherein each of said flats comprises clothing divided into at least two clothing groups, each of said clothing groups differing in clothing point density.

8. The carding machine as in claim 3, wherein each of said flats comprises clothing divided into at least two clothing groups, each of said clothing groups having a different clothing strength.

9. The carding machine as in claim 1, wherein each of said flats comprises clothing having a breast angle exceeding about 30 degrees.

10. The carding machine as in claim 9, wherein said breast angle is between about 35 degrees to about 50 degrees.

11. The carding machine as in claim 1, wherein an under-carding zone is defined under said main carding drum enclosed by an angle defined at a rotational axis of said main carding drum of less than about 90 degrees.

12. The carding machine as in claim 1, wherein said main carding drum is driven at a rotational speed of between about 300 to about 600 revolutions per minute.

13. The carding machine as in claim 1, further comprising a doffing system disposed to collect carded fibers over said working width, said doffing system comprising a doffer roll having a diameter such that a ratio of said diameter of said main carding drum to said diameter of said doffer roll is less than about 1.8.

14. The carding machine as in claim 1, wherein said feeding system further comprises a feed chute and a feed roll, said feed chute delivering fiber material in the form of a fiber batt to said feed roll, and further comprising a cleaning device configured with said feed chute to clean fiber material conveyed through said feed chute.

15. The carding machine as in claim 1, wherein said main drum is formed from a fiber reinforced synthetic material compound.

16. The carding machine as in claim 15, wherein said compound comprises a glass fiber and resin compound.

17. The carding machine as in claim 15, wherein said main drum comprises end supports each having a hub, spokes, and a rim, said end supports being made of metal.

18. A carding machine, comprising:

at least one main carding drum having a substantially cylindrical surface with clothing provided thereon defining a working width of said main carding drum of greater than about 1300 mm;

said main carding drum having a diameter between about 700 mm to 900 mm;

a set of flats disposed relative to said main carding drum for uniform carding of fibers on said main carding drum over said working width;

a feeding system disposed to uniformly feed said main carding drum with fibers to be processed over said working width, said feeding system comprising a single transfer location for transferring fibers to said main carding drum;

wherein said main drum is formed from a fiber reinforced synthetic material compound;

wherein said compound comprises a glass fiber and resin compound; and wherein said main drum has a wall of predetermined thickness and said glass fiber is wound helically into said wall.

19. A carding machine, comprising:

at least one main carding drum having a substantially cylindrical surface with clothing provided thereon defining a working width of said main carding drum of greater than about 1300 mm;

said main carding drum having a diameter between about 700 mm to 900 mm;

a set of flats disposed relative to said main carding drum for uniform carding of fibers on said main carding drum over said working width;

a feeding system disposed to uniformly feed said main carding drum with fibers to be processed over said working width, said feeding system comprising a single transfer location for transferring fibers to said main carding drum;

wherein said main drum is formed from a fiber reinforced synthetic material compound; and wherein said main drum further comprises a clothing wound on an outer circumferential surface thereof with a winding tension so as to generate compressive stress in said fiber reinforced synthetic material compound.

20. The carding machine as in claim 19, wherein said main drum comprises a circumferential wall defining said outer circumferential surface, said wall having a thickness in a range of about 15 mm to about 20 mm.

21. A carding machine, comprising:

at least one main carding drum having a substantially cylindrical surface with clothing provided thereon defining a working width of said main carding drum of greater than about 1300 mm;

said main carding drum having a diameter between about 700 mm to 900 mm;

a set of flats disposed relative to said main carding drum for uniform carding of fibers on said main carding drum over said working width;

a feeding system disposed to uniformly feed said main carding drum with fibers to be processed over said working width, said feeding system comprising a single transfer location for transferring fibers to said main carding drum;

wherein said main drum is formed from a fiber reinforced synthetic material compound; and wherein said main drum further comprises a clothing wound on an outer circumferential surface thereof, said clothing being grounded so that electrostatic charges that may build do not adversely effect the carding process.

* * * * *